US007975455B1

(12) United States Patent
Abrahamsen

(10) Patent No.: US 7,975,455 B1
(45) Date of Patent: Jul. 12, 2011

(54) PACKAGING METHOD FOR GLOVES PROVIDING NONBINDING DISPENSING OF INDIVIDUAL ITEMS

(76) Inventor: Kurt Glenn Abrahamsen, Powhatan, VA (US)

( * ) Notice: Subject to any disclaimer, the term of this patent is extended or adjusted under 35 U.S.C. 154(b) by 245 days.

(21) Appl. No.: 12/387,704

(22) Filed: May 6, 2009

(51) Int. Cl.
*B65B 1/04* (2006.01)

(52) U.S. Cl. ..... 53/437; 53/471; 53/428

(58) Field of Classification Search ..... 53/428, 53/396, 437, 438, 467, 471
See application file for complete search history.

(56) References Cited

U.S. PATENT DOCUMENTS

| | | | | |
|---|---|---|---|---|
| 4,069,913 | A * | 1/1978 | Harrigan | 206/278 |
| 4,159,069 | A * | 6/1979 | Poncy et al. | 223/111 |
| 4,275,812 | A * | 6/1981 | Poncy et al. | 206/278 |
| 4,567,065 | A * | 1/1986 | Schneiderman | 427/230 |
| 4,915,226 | A | 4/1990 | Keenan | |
| 4,942,992 | A * | 7/1990 | Fischer et al. | 224/240 |
| 4,993,589 | A * | 2/1991 | McLaughlin | 221/33 |
| 4,997,105 | A * | 3/1991 | Fischer | 221/45 |
| 5,088,620 | A * | 2/1992 | Kelliher et al. | 221/59 |
| 5,096,089 | A * | 3/1992 | McLaughlin | 221/26 |
| 5,175,977 | A * | 1/1993 | Crawford et al. | 53/399 |
| 5,392,974 | A * | 2/1995 | Johnson-Rabbett | 224/674 |
| 5,590,764 | A * | 1/1997 | Wood | 206/278 |
| 5,816,440 | A * | 10/1998 | Shields et al. | 221/45 |
| 5,921,434 | A * | 7/1999 | Hollander et al. | 221/34 |
| 5,927,543 | A * | 7/1999 | Dejardin et al. | 221/56 |
| 6,062,421 | A * | 5/2000 | Marley | 221/45 |
| 6,095,326 | A | 8/2000 | Madhat et al. | |
| 6,112,936 | A * | 9/2000 | Arizmendi | 221/45 |
| 6,375,034 | B1 * | 4/2002 | Corbett | 221/46 |
| 6,497,340 | B2 * | 12/2002 | Grinberg | 221/45 |
| 6,708,841 | B2 * | 3/2004 | Baughman | 221/46 |
| 7,063,233 | B2 | 6/2006 | Jordan et al. | |
| 7,731,056 | B2 * | 6/2010 | Tramontina | 221/36 |
| 2003/0057222 | A1 * | 3/2003 | Milliorn | 221/46 |
| 2004/0245269 | A1 * | 12/2004 | Grinberg | 221/38 |
| 2006/0049199 | A1 * | 3/2006 | West | 221/26 |
| 2008/0314920 | A1 * | 12/2008 | Rodrigues | 221/63 |
| 2009/0261001 | A1 * | 10/2009 | Yao et al. | 206/223 |

* cited by examiner

*Primary Examiner* — Paul R Durand

(57) ABSTRACT

A packaging method for gloves that provides nonbinding dispensing of individual gloves. The method includes providing a durable and re-sealable container and a plurality of ambidextrous gloves constructed of rubber, placing a plurality of tightly packed gloves in a fluffing machine, air fluffing and tumbling the plurality of gloves for a period of time, loading a measured amount of gloves in the container, applying a cover to the container, and providing a seal around the juncture of the cover and the container.

19 Claims, 9 Drawing Sheets

PACKAGING METHOD FOR GLOVES PROVIDING NONBINDING DISPENSING OF INDIVIDUAL ITEMS

FIELD OF THE INVENTION

This invention relates to packaging of gloves for protection of the hands and specifically to an improved method of packaging disposable gloves in an easy dispensing container.

BACKGROUND OF THE INVENTION

Disposable gloves are typically packed in a paper box similar to a conventional facial tissue box. Such a prior art box 10 is shown in FIGS. 10 and 11. The conventional glove box 10 is typically of unitary paper construction and includes a bottom 11, sides 12, and top 13 that define an open cavity 14 therein. A measured quantity of gloves 15 are loaded within the cavity 14. A slot 16, situated in the top 13 of the box 10, provides an opening for a user to access the gloves 15 within the box 10. The slot 16 is typically narrow to prevent a user from grasping more than one or two gloves at a time. The purpose of the prior art glove box 10 is to enable a user to extract one glove or two gloves at a time as needed for use in surgery, food preparation, automobile repair, or other applications.

Unfortunately, there are several disadvantages with the conventional glove packaging method as shown in FIGS. 10 and 11. One disadvantage of the packaging method is that the box is constructed of paper, which is a substantially weak material. Gloves are typically constructed of elastomeric materials such as latex rubber, which is substantially tougher than paper. Unlike tissues, which are folded and stacked by machinery and then inserted in an ordered fashion in the tissue box, gloves are dispersed randomly in the conventional glove box. As a result of the gloves being dispersed randomly, the gloves become interlocked and it is difficult to remove a single glove from the box. A consequence of the gloves becoming interlocked, a portion of the conventional paper glove box surrounding the top opening will frequently be torn as a user attempts to pull a glove from the box. At other times, a glove will be torn as it is pulled from the box as a result of the tightly packed gloves within the box exerting substantial pressure on other gloves that it is in contact with. Another negative consequence of the light paper construction and the tightly packed gloves is that the glove box frequently lifts off of the surface that it is resting on, thereby causing the user to apply two hands to the box in order to dispense a glove.

A further drawback of the conventional paper glove box is that, as a result of the opaque paper construction and the narrow slot for dispensing a single glove, only a narrow portion of the gloves within the box are visible to the user. Thus, it is extremely difficult for a user to discern whether they have grasped a single glove or a plurality of gloves at once. In the case of surgical gloves this leads to considerable waste as any gloves that are spilled out of the box are typically considered unsanitary and are discarded without being used. Additionally, once the seal at the slot of the paper box glove dispenser is removed, there is no easy way of resealing the box to protect the gloves.

What is needed therefore is an improved packaging method that stores gloves in such a manner that they are loosely dispersed within a container and can be easily dispensed one at a time. The packaging method should include a container that is structurally sound for storage and shipping and not easily torn or deformed when gloves are removed there from. The packaging method should further provide good visibility to enable a user to extract only the desired amount of gloves at a time. The packaging method should further include a resealing method to enable sealing off the opened container after the initial use.

SUMMARY OF THE INVENTION

The invention is a packaging method for gloves that provides nonbinding dispensing of individual gloves. The method includes providing a durable and re-sealable container and a plurality of ambidextrous gloves constructed of rubber, placing a plurality of tightly packed gloves in a fluffing machine, air fluffing and tumbling the plurality of gloves for a period of time, loading a measured amount of gloves in the container, applying a cover to the container, and providing a seal around the juncture of the cover and the container.

OBJECTS AND ADVANTAGES

Several advantages are achieved with the packaging method for gloves of the present invention, including:

(1) The packaging method of the present invention provides a durable container for the storage and shipping of gloves.

(2) Dispensing of individual gloves is greatly simplified over conventional glove dispensers.

(3) The packaging method ensures that the gloves are highly visible to the consumer at any time, including at the point of purchase or during later storage.

(4) The high visibility of the gloves provided by the packaging method enables a user to quickly determine when it is time to reorder.

(5) Colors of individual items within the package are easily discernible.

(6) The packaging method ensures that each individual glove is easily separable from the plurality of gloves in the container.

(7) The packaging method provides a container cannot be torn or deformed with time as the stored gloves are extracted from the container.

(8) The packaging method provides a cover member that can be resealed in order to maintain the remaining gloves in the container in a closed environment.

These and other objects and advantages of the present invention will be better understood by reading the following description along with reference to the drawings.

INDEX TO REFERENCE NUMERALS IN DRAWINGS

Figure 1:
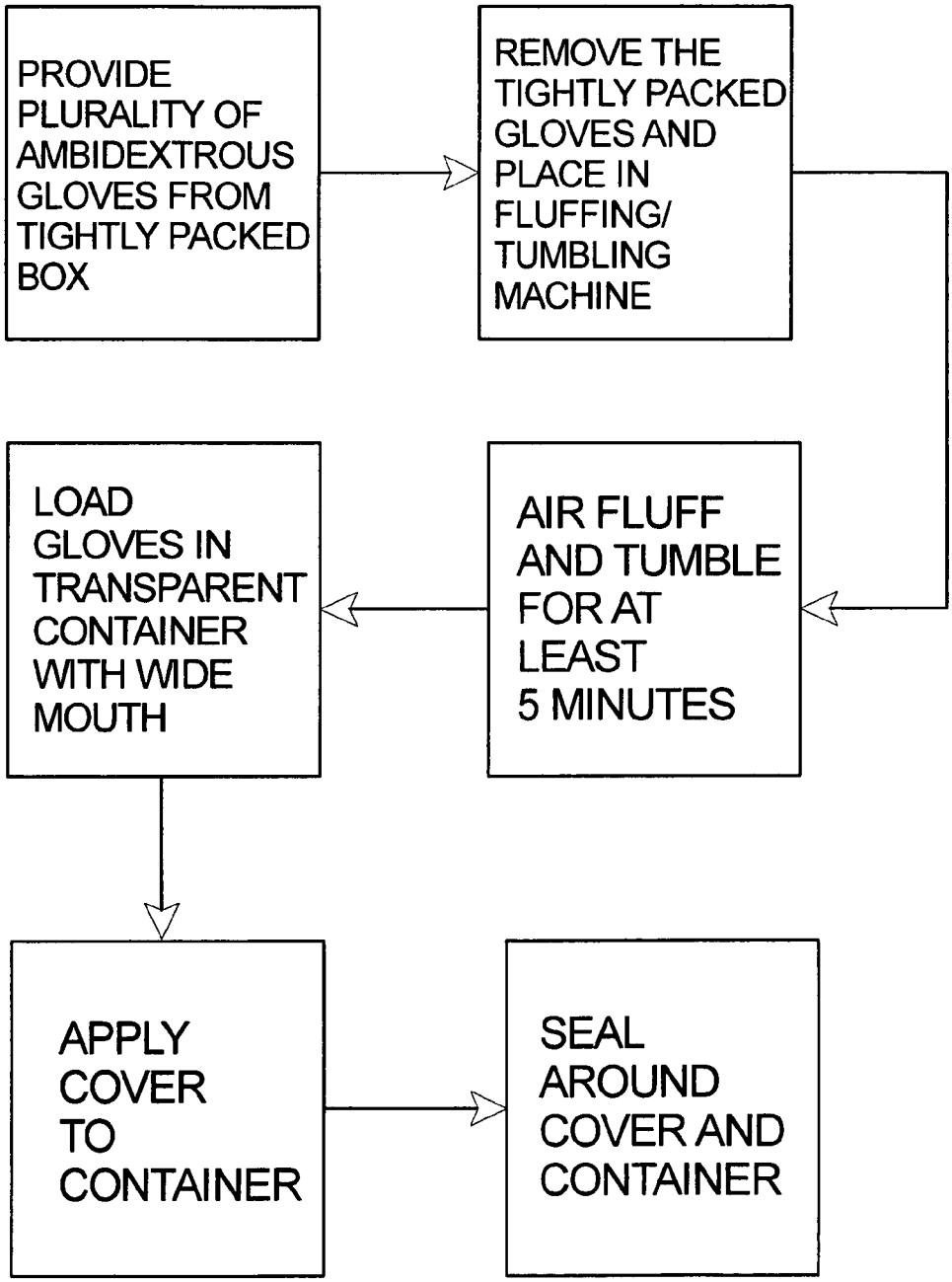
FIG. 1 is a flowchart depicting the sequence of steps defining the packaging method of the present invention.

10 conventional paper box dispenser (prior art)
11 bottom
12 sides
13 top
14 open cavity
15 gloves
16 slot
20 glove container, preferred embodiment
22 bottom
24 sidewall
26 shoulder
28 top wall
30 neck
32 top edge
34 ridge
36 opening or mouth
38 cavity
40 lip
42 gloves
44 cover
46 lower edge of shoulder
48 panel of cover
50 outer edge
52 rim
54 recessed portion of panel
56 gap
58 first sealing surface
60 second sealing surface
62 outer seal
64 label
66 side
68 glove
D1 inner diameter of neck portion of container
D2 outer diameter of neck portion of container
D3 inner diameter of rim of cover
W1 width of container

DETAILED DESCRIPTION OF THE INVENTION

With reference to FIG. 1 there is shown a flowchart depicting the sequence of steps defining a preferred embodiment of a packaging method for gloves according to the present invention. The packaging method includes the steps of: 1) providing a plurality of ambidextrous gloves constructed of rubber, 2) providing a durable container, 3) removing the tightly packed gloves and placing them in an air fluffing and tumbling machine, 4) air fluffing the plurality of gloves for a minimum period of time, 5) loading the air fluffed gloves in the container, 6) applying a flexible cover to the container, and 7) sealing around the juncture of the cover and container.

Figure 2:
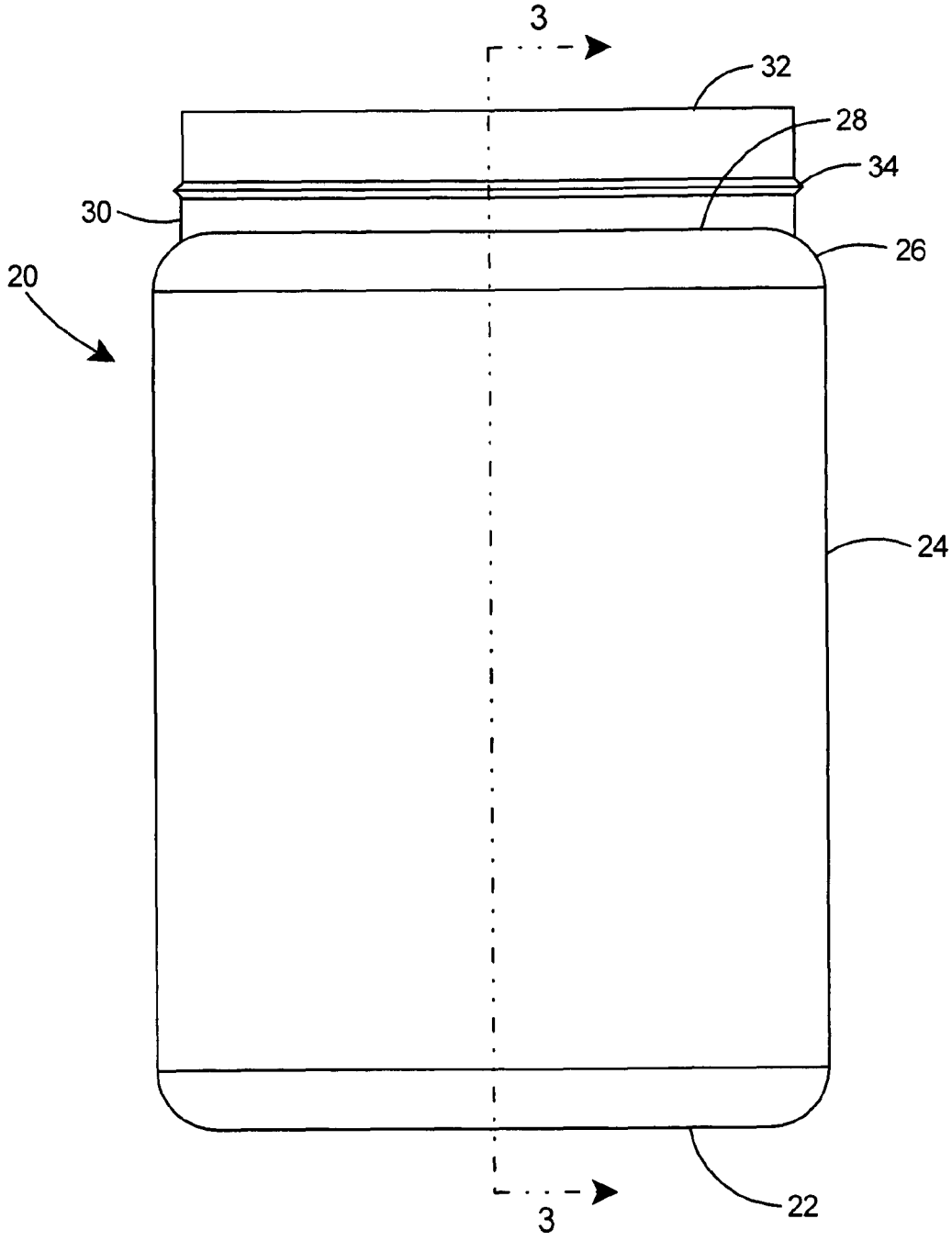
FIG. 2 is a side view of an empty container that forms a portion of the packaging method of the present invention.

As shown in FIG. 2, the preferred method of packaging gloves described herein includes a freestanding and substantially rigid container 20. The container 20 includes a bottom 22, a sidewall 24, a shoulder 26, a top wall 28, and a neck 30 extending from the top wall 28. The container 20 further includes a top edge 32 on the upper end of the container and a ridge 34 extending around the neck 30.

Figure 3:
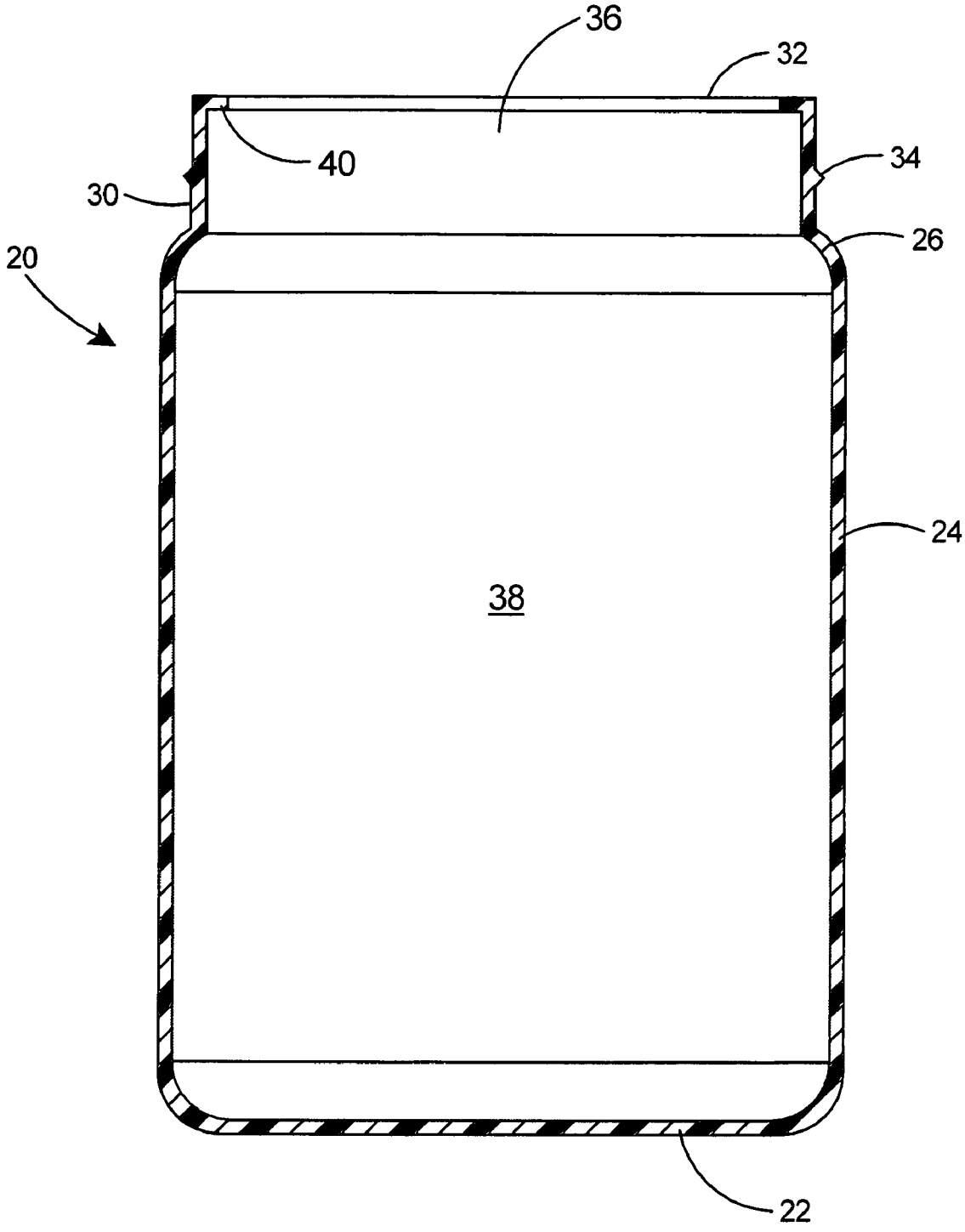
FIG. 3 is a sectional view of the container taken along line 3-3 of FIG. 2.

With reference to the sectional view of the container 20 in FIG. 3, the neck 30 includes an opening 36 therein leading into a cavity 38 defined by the bottom 22, sidewall 24, and top wall 28. A lip 40 at the top edge 32 of the container 20 extends inward of the neck 30.

Figure 4:
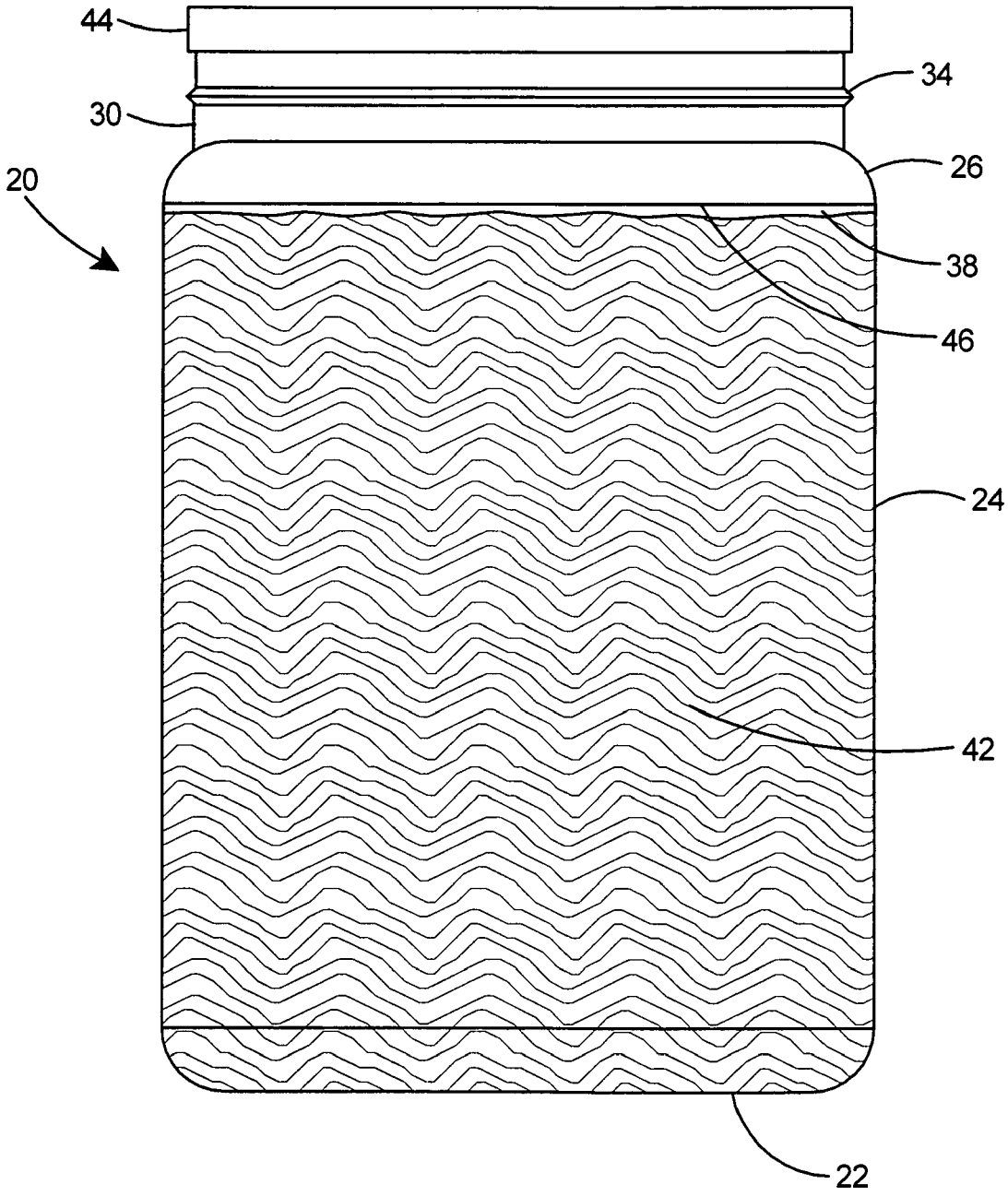
FIG. 4 is a side view of the container of FIG. 2 after it has been filled with gloves according to the packaging method depicted in FIG. 1.

With reference to FIG. 4, after the container 20 has been filled with a measured quantity of air fluffed gloves 42, a flexible cover 44 is placed on the neck 30 of the container 20 to seal the container 20. Preferably, the air fluffed gloves 42 fill the cavity 38 within the container 20 to approximately the lower edge 46 of the shoulder 26 as shown. In order to eliminate the need to pull a matching pair of gloves from the container, the gloves 42 are preferably ambidextrous. For some applications, such as surgical use, the gloves are hypoallergenic to minimize the possibility of an allergic reaction caused by the gloves. In the packaging method of the present invention, the gloves 42 are constructed of synthetic rubber. Most preferably, the gloves are constructed of acrylonitrile, latex, or polyvinyl chloride. Typically, disposable gloves constructed of these materials are supplied by manufacturers in a tightly packed mass within a cardboard box. In the packaging method of the present invention, the tightly packed mass of gloves are removed from the cardboard box and placed in a fluffing and tumbling machine. The air fluffing and tumbling step of the current packaging method renders the gloves non-sticking and easy donning without the use of conventional nonstick methods such as powders. In the packaging method of the present invention, the air fluffing step preferably includes repeated tumbling of a plurality of gloves while air is passed there through for at least 5 minutes. Preferably, the container 20 used in the packaging method of the present invention is constructed of plastic and is transparent. The plastic material of construction of the container 20 is preferably polyvinyl chloride, high density polyethylene, or polyethylene terephthalate. The gloves used in the packaging method of the present invention are preferably disposable.

Figure 7:
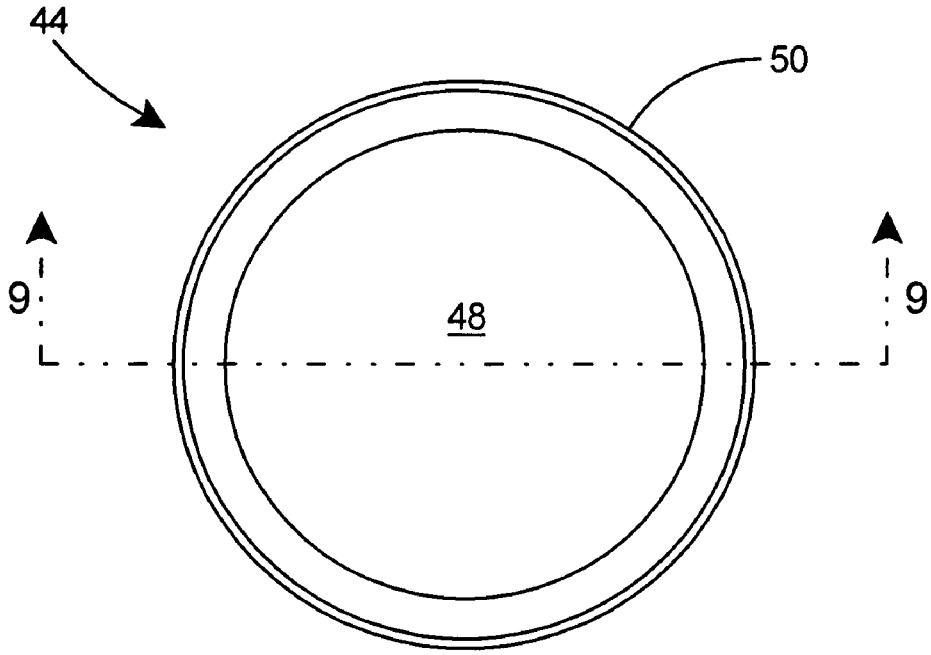
FIG. 7 is a top view of a cover that forms a portion of the packaging method of the present invention.
Figure 8:
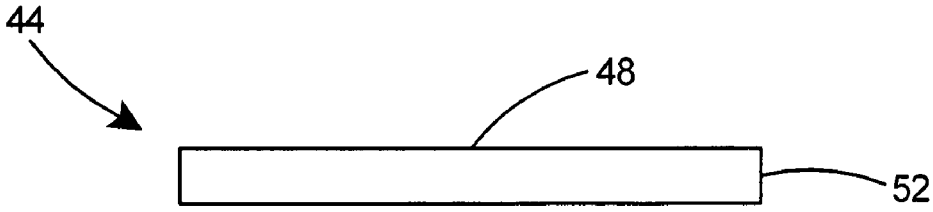
FIG. 8 is a side view of the cover of FIG. 6.
Figure 9:
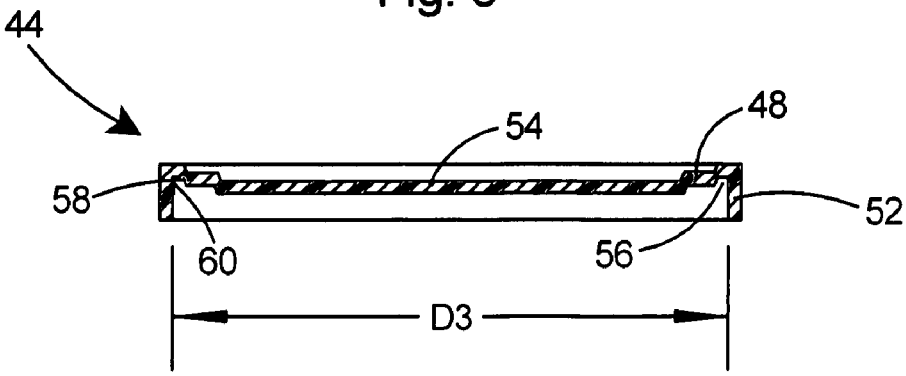
FIG. 9 is a sectional view of the cover taken along line 9-9 of FIG. 7.
Figure 10:
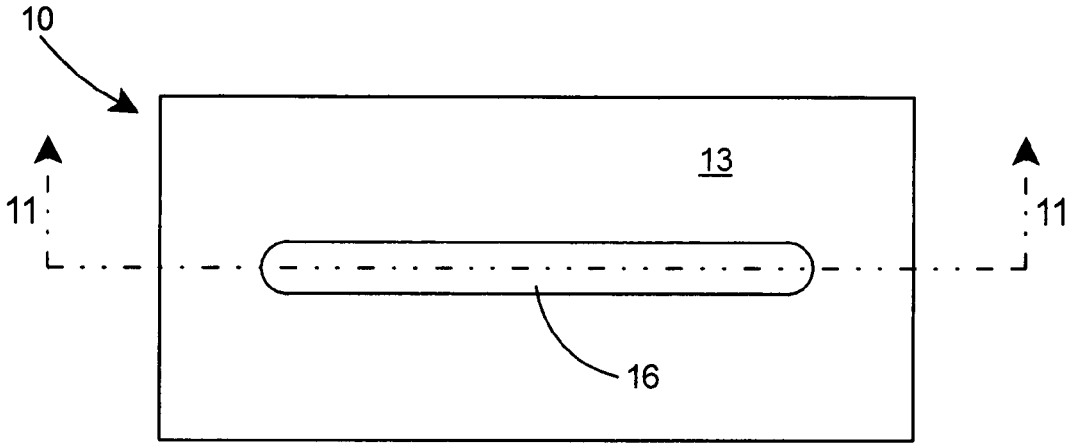
(PRIOR ART) Fig. 10
FIG. 10 is a top view of a prior art paper packaging container for gloves.
Figure 11:
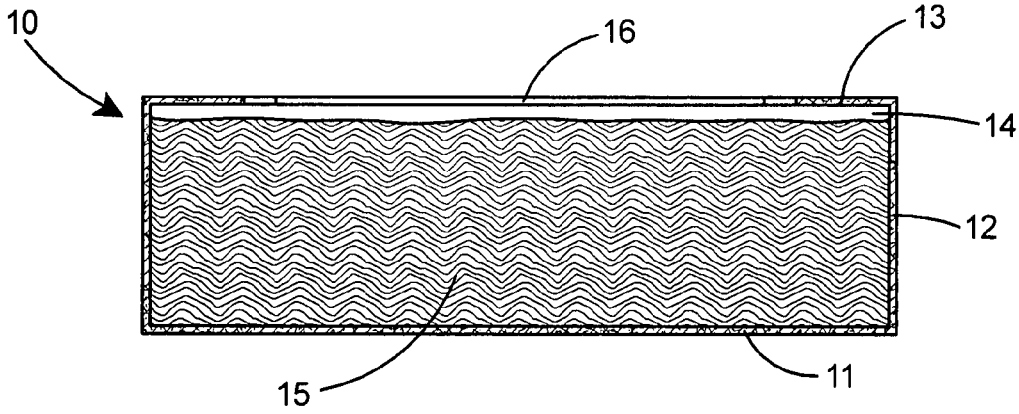
(PRIOR ART) Fig. 11
FIG. 11 is a sectional view of the prior art paper packaging container taken along line 11-11 of FIG. 10.

Referring to FIGS. 7-9, the cover 44 used in the packaging method of the present invention includes a panel portion 48 having an outer edge 50 and a rim 52 extending downward from the outer edge 50 of the panel 48. The cover 44 is preferably flexible and constructed of plastic. Most preferably the plastic material of construction of the cover 44 is low density polyethylene. The rim 52 of the cover 44 includes an inner diameter D3 as shown in FIG. 9. The cover 44 further includes a recessed portion 54 in the panel 48 inward of the rim 52 and a gap 56 between the rim 52 and the recessed portion 54. The gap 56 provides a first sealing surface 58 and a second sealing surface 60 for sealing the cover on the container.

Figure 5:
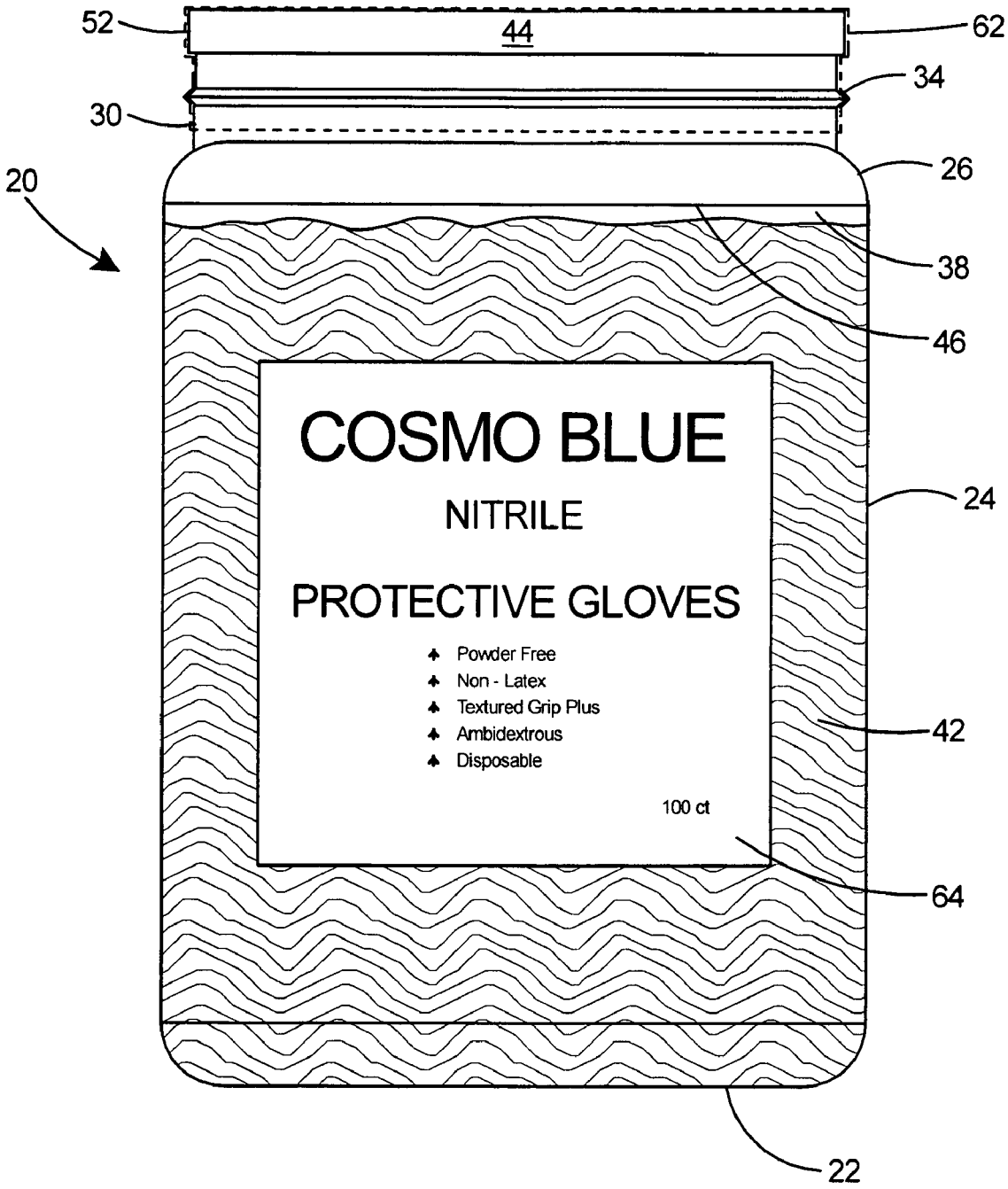
FIG. 5 is a side view of the container of FIG. 3 after it has been affixed with a label identifying the contents therein.

With reference to FIG. 5, after the container 20 has been filled with gloves 42 and the cover 44 has been placed on the neck 30 of the container 20, an outer seal 62 (shown in broken lines) is applied around the rim-52 of the cover 44 and the neck 30 of the container 20. The outer seal 62 covers the ridge 34 of the neck 30. The outer seal 62 is preferably constructed of shrink wrap film and is sealed on the cover 44 and neck 30 of the container 20 with the application of heat. As shown in FIG. 5, after the container 20 is filled with gloves 42 and sealed with a flexible cover 44 and a film outer seal 62, a label 64 is applied to the sidewall 24 of the container 20. The label 64 includes indicia indicating the material within the container 20 and various identifying information, such as the material of construction, the number of gloves 42 within the container 20, and indicia indicating that the gloves 42 are powder free, ambidextrous, and disposable. A container 20 and cover 44 such as disclosed in the packaging method of the present invention are available from Rez-Tech Corporation of Kent, Ohio.

The packaging method of the present invention overcomes several disadvantages of prior art glove storage containers that are typically constructed of paper. As shown in FIG. 5, the packaging method provides a durable, freestanding, re-sealable container for the storage of gloves. The wide opening or mouth of the container 20 makes it easy to dispense individual gloves as the mouth is wide enough to accommodate a user's hand. The container is transparent, thereby making the gloves stored therein highly visible to the consumer and allowing the consumer to view the color of the stored items and determine when he is nearing the reorder point. The air fluffing and tumbling of the tightly packed gloves renders the gloves in such a manner that they do not stick to one another and therefore enables easy selection and separation of individual items from the container. The packaging container 20, being of durable plastic construction, cannot be torn or deformed with time as is common with prior art paper storage containers. The packaging method of the present invention further provides a resealing method in the form of a flexible cover. Prior art paper storage methods are open to the environment after initial opening and are not resealable.

Figure 6:
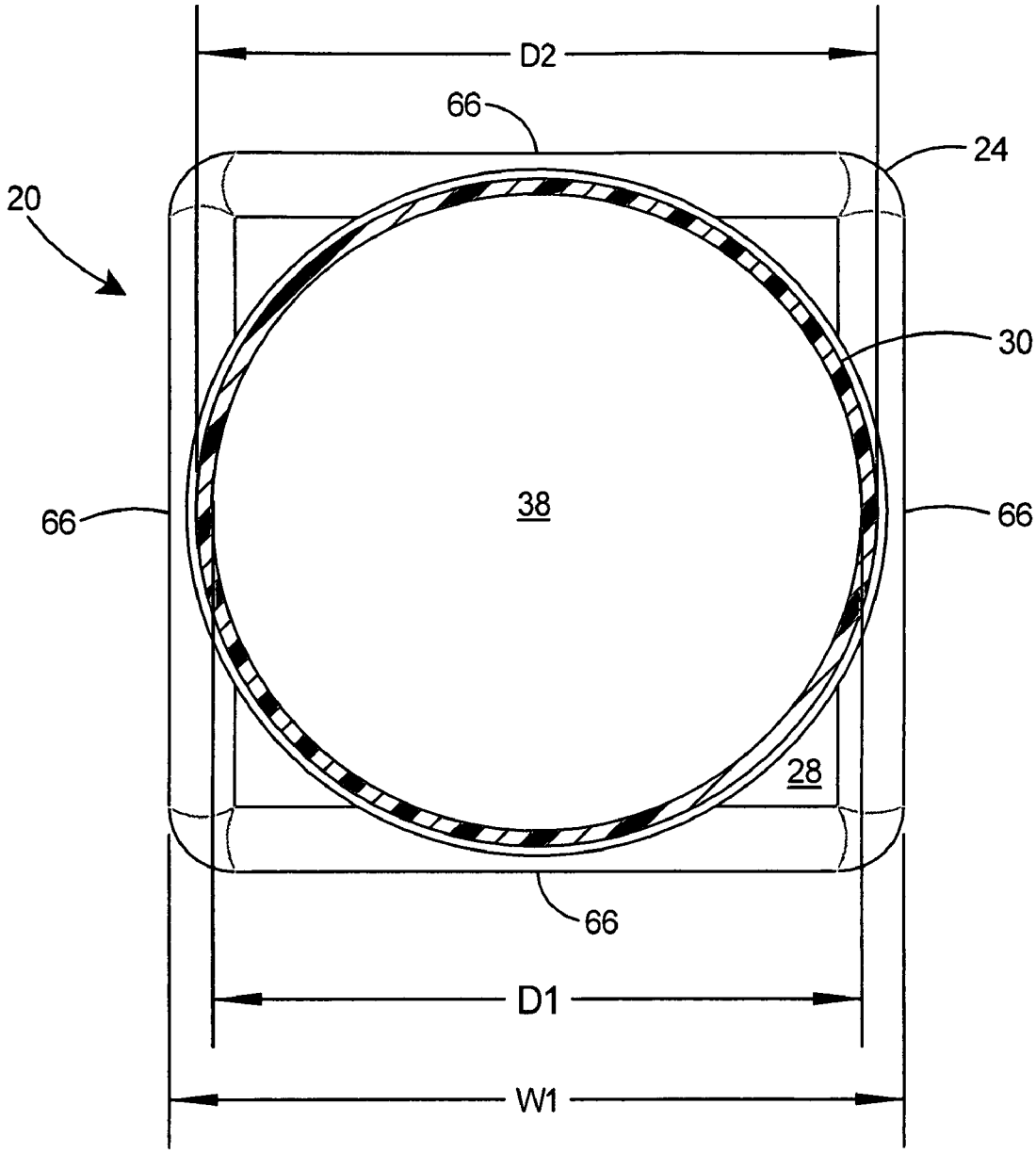
FIG. 6 is a top view of the container of FIG. 2.

Referring to FIG. 6, the container 20 used in the packaging method of the present invention preferably includes a width W1 across the cavity 38 and the neck 30 includes an inner diameter D1 and an outer diameter D2. Preferably, the inner diameter D1 of the neck 30 is at least 85% of the width W1 of the cavity 38 to enable easy extraction of stored items by hand. Preferably, for a container of nominal width W1 of 5.5 inches, the inner diameter D1 of the neck 30 is between 4.5 and 4.7 inches. Most preferably, the inner diameter D3 of the rim 52 of the cover member 44 as shown in FIG. 9, is slightly smaller than the outer diameter D2 of the neck 30 of the container 20 as shown in FIG. 6 thus enabling the flexible cover 44 to reseal against the neck portion 30 of the container 20 when the cover 44 is replaced on the container 20 after the extraction of gloves from the container 20. As further shown in FIG. 6, the sidewall 24 of the container 20 preferably includes four sides 66. The top wall 28 is of square shape and the neck 30 extending from the top wall 28 of the container is of circular shape.

Figure 12:
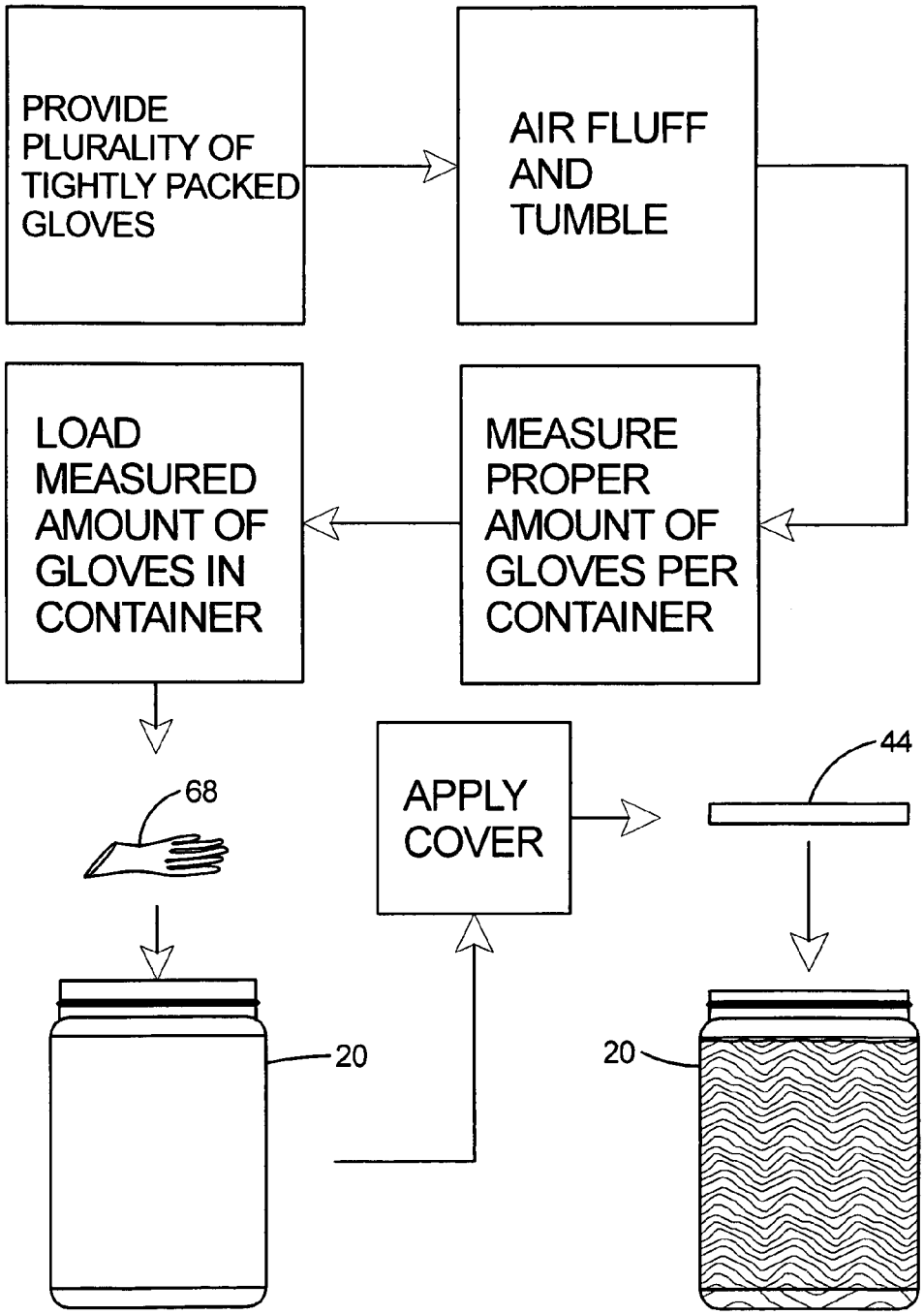
FIG. 12 is a combination flowchart and schematic depicting a portion of the sequence of steps defining the packaging method of the present invention.

With reference to FIG. 12 there is shown a combination flowchart and schematic depicting a portion of the sequence of steps defining the packaging method of the present invention. As shown in the figure, the packaging method includes loading air fluffed gloves 68 into a container 20.

Although the description above contains many specific descriptions, materials, and dimensions, these should not be construed as limiting the scope of the invention but as merely providing illustrations of some of the presently preferred embodiments of this invention. Thus the scope of the invention should be determined by the appended claims and their legal equivalents, rather than by the examples given.

What is claimed is:

1. A method of packaging gloves including:

providing a plurality of said gloves in tightly packed form;

providing a container including a bottom, a sidewall, and a top wall defining a cavity therein, said container including a neck extending from said top wall and an opening in said neck;

providing a cover for covering said neck and said opening;

providing said opening of said container with a width to accept the entrance of a hand;

removing said tightly packed gloves from said tightly packed form;

air fluffing and tumbling said plurality of said gloves for at least 5 minutes;

placing a measured quantity of said gloves through said opening into said cavity of said container; and placing said cover on said neck of said container.

2. The method of claim 1 wherein said container is freestanding and substantially rigid.

3. The method of claim 1 wherein said container is transparent.

4. The method of claim 1 wherein said container is constructed of plastic.

5. The method of claim 4 wherein said plastic is selected from the group including polyvinyl chloride, high density polyethylene, and polyethylene terephthalate.

6. The method of claim 1 wherein said gloves are ambidextrous.

7. The method of claim 1 wherein said gloves are constructed of synthetic rubber.

8. The method of claim 7 wherein said synthetic rubber is selected from the group including acrylonitrile, latex, and polyvinyl chloride.

9. The method of claim 1 wherein said gloves are hypoallergenic.

10. The method of claim 1 wherein said cover is flexible.

11. The method of claim 1 wherein said cover is constructed of plastic.

12. The method of claim 11 wherein said plastic is low density polyethylene.

13. The method of claim 1 wherein said cover includes a panel portion having an outer edge; and a rim extending from said outer edge of said panel.

14. The method of claim 13 wherein said container includes a width across said cavity;

said neck includes an inner diameter; and said inner diameter of said neck is at least 85% of said width of said cavity.

15. The method of claim 14 wherein said rim of said cover includes an inner diameter; and said inner diameter of said rim is slightly smaller than said outer diameter of said neck of said container.

16. The method of claim 13 wherein said container includes a ridge extending around said neck; and said packaging method includes applying an outer seal around said rim of said cover and said neck of said container, said outer seal covers said ridge of said neck.

17. The method of claim 16 wherein said outer seal is constructed of shrink wrap film.

18. The method of claim 1 wherein said cover includes a recessed portion in said panel inward of said rim; and a gap between said rim and said recessed portion, said gap providing an inner surface and outer surface for sealing said cover on said container.

19. The method of claim 1 wherein said container includes four of said sidewalls and said top wall is of square shape; and said neck extending from said top wall of said container is circular.

* * * * *